US006589608B2

(12) United States Patent
Deus et al.

(10) Patent No.: US 6,589,608 B2
(45) Date of Patent: Jul. 8, 2003

(54) PROCESS FOR THE VACUUM COATING OF METAL COMPONENTS

(75) Inventors: Carsten Deus, Dresden (DE); Joachim Senf, Dresden (DE); Lutz Wolkers, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 5 days.

(21) Appl. No.: 09/821,856

(22) Filed: Mar. 30, 2001

(65) Prior Publication Data

US 2001/0031314 A1 Oct. 18, 2001

Related U.S. Application Data

(63) Continuation of application No. PCT/DE99/03236, filed on Sep. 30, 1999.

(30) Foreign Application Priority Data

Sep. 30, 1998 (DE) ..... 198 45 803

(51) Int. Cl.[7] ..... C23C 16/46

(52) U.S. Cl. ..... 427/533; 427/551; 427/255.26; 148/276; 148/277; 148/285

(58) Field of Search ..... 427/533, 551, 427/255.26; 148/276, 277, 285

(56) References Cited

U.S. PATENT DOCUMENTS 5,262,245 A 11/1993 Ulion et al.
5,514,482 A * 5/1996 Strangman ..... 427/383.7
5,763,107 A 6/1998 Rickerby et al.

FOREIGN PATENT DOCUMENTS

DE 19703338 A1 7/1998

* cited by examiner

*Primary Examiner*—Timothy Meeks
(74) *Attorney, Agent, or Firm*—Laurence A. Greenberg; Werner H. Stemer; Ralph E. Locher

(57) ABSTRACT

A process for producing a homogeneous oxide layer on metal components includes uniformly heating the components, in all their regions, in a vacuum chamber and, after a predetermined temperature has been reached, exposing the components to an oxygen-containing gas for a predetermined period and at a predetermined pressure. The metal components are coated with MCrAlY or PtAl. The preheating temperature is between 750 and 850° C., preferably, approximately 800° C. Preferably, the thickness of the homogeneous oxide layer is between 0.01 and 5 $\mu$m. The heating is preferably by electron radiation. The predetermined period is approximately 10 minutes, and the predetermined pressure is between $1\times10^{-3}$ and $8\times10^{-2}$ mbar.

3 Claims, No Drawings

PROCESS FOR THE VACUUM COATING OF METAL COMPONENTS

CROSS-REFERENCE TO RELATED APPLICATION

This application is a continuation of copending International Application No. PCT/DE99/03236, filed Sep. 30, 1999, which designated the United States.

BACKGROUND OF THE INVENTION

Field of the Invention

The invention lies in the field of coatings. The invention relates to a process for the vacuum coating of metal components, in which the metal components, in all their regions, are uniformly preheated to a temperature of approximately 800° C. in a vacuum chamber by electron radiation.

A coating process is disclosed in German Published, NonProsecuted Patent Application DE 197 03 338 A1. The prior art process is used to preheat workpieces during vacuum coating so that the workpiece or metal component in question can be preheated uniformly using electron beams in a vacuum chamber for the workpiece to be subsequently coated in vacuo.

SUMMARY OF THE INVENTION

It is accordingly an object of the invention to provide a process for the vacuum coating of metal components that overcomes the hereinafore-mentioned disadvantages of the heretofore-known devices and methods of this general type and that provides a process for producing a homogeneous oxide layer on metal components with which it is possible to apply the oxide layer in a controlled and reproducible manner.

DESCRIPTION OF THE PREFERRED EMBODIMENT

With the foregoing and other objects in view, there is provided, in accordance with the invention, a process for vacuum coating of metal components, including the steps of uniformly preheating all regions of metal components coated with at least one of MCrAlY and PtAl to a temperature of approximately 800° C. in a vacuum chamber by electron radiation, and after reaching a predetermined temperature for producing a homogeneous oxide layer on the metal components, exposing the metal components to an oxygen-argon mixture for a period of approximately 10 minutes at a pressure of between $1\times10^{-3}$ and $8\times10^{-2}$ mbar.

A significant advantage of the process according to the invention is in the fact that with the process, homogeneous oxide layers can be applied in a controlled manner to metal components that are coated with MCrAlY or PtAl, and the oxide layers are reproducible, in other words, can be produced in a targeted manner in terms of their layer thickness and structure. It is, consequently, possible to optimize the oxidation layer as an independent layer in a targeted manner with regard to adhesion and other mechanical or chemical properties.

In a preferred embodiment of the process according to the invention for producing a homogeneous oxide layer on turbine blades having a nickel-based or cobalt-based base material and that are coated with MCrAlY or PtAl, the turbine blades are accommodated in an evacuated chamber. Taking into account the mass distribution of the turbine blades, an electron radiation follows with a different dose for the root, the blade, and the end plate of the turbine blades. A significantly higher dose of electron radiation is provided in the roots and in the end plate, due to the greater mass in those regions, than for the blade. When the whole of the turbine blade has reached a uniform minimum temperature of approximately 750 to 850° C., an oxygen/argon mixture with a partial pressure of between $1\times10^{-3}$ and $8\times10^{-2}$ mbar is introduced into the evacuated chamber for a minimum period of about ten (10) minutes. The result is a turbine blade having a homogeneous oxide layer with a thickness of between 0.01 and 5 $\mu$m.

The process described can be modified such that the metal components to be provided with an oxide layer are exposed in a component-specific manner to the oxygen/argon mixture by special gas showers to produce a particularly homogeneous oxide layer.

Other modes that are considered as characteristic for the invention are set forth in the appended claims.

Although the invention is described herein as embodied in a process for the vacuum coating of metal components, it is, nevertheless, not intended to be limited to the details described because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments.

We claim:

1. A process for vacuum coating of metal components, which comprises:

uniformly preheating by electron radiation all regions of metal components coated with at least one of MCrAlY and PtAl to a predetermined temperature of approximately 800° C. in a vacuum chamber; and after reaching the predetermined temperature due to the electron radiation, exposing the metal components to an oxygen-argon mixture for a period of approximately 10 minutes at a pressure of between $1\times10^{-3}$ and $8\times10^{-2}$ mbar for producing a homogeneous oxide layer on the metal components.

2. A process for vacuum coating of metal components, which comprises:

uniformly preheating by electron radiation all regions of metal components coated with at least one of MCrAlY and PtAl to a predetermined temperature of between 750° C. and 850° C. in a vacuum chamber; and after reaching the predetermined temperature due to the electron radiation, exposing the metal components to an oxygen-argon mixture for a period of approximately 10 minutes at a pressure of between $1\times10^{-3}$ and $8\times10^{-2}$ mbar for producing a homogeneous oxide layer on the metal components.

3. A process for vacuum coating of metal components, which comprises:

uniformly preheating by electron radiation all regions of metal components coated with at least one of MCrAlY and PtAl to a predetermined temperature of approximately 800° C. in a vacuum chamber; and after reaching the predetermined temperature due to the electron radiation, exposing the metal components to an oxygen-argon mixture for a period of approximately 10 minutes at a pressure of between $1\times10^{-3}$ and $8\times10^{-2}$ mbar for producing a homogeneous oxide layer having a thickness of between 0.01 and 5 $\mu$m on the metal components.

* * * * *